US007513453B2

(12) United States Patent
Cattacin et al.

(10) Patent No.: US 7,513,453 B2
(45) Date of Patent: Apr. 7, 2009

(54) SYSTEM FOR DISPENSING PAPER IN A CORELESS ROLL, METHOD OF MANUFACTURING A ROLL OF THIS TYPE, AND ROLL OF PAPER

(75) Inventors: Gilles Cattacin, Colmar (FR); Jean-Louis Neveu, Colmar (FR); Nicolas Pommier, Colmar (FR)

(73) Assignee: Georgia-Pacific France (FR)

( * ) Notice: Subject to any disclaimer, the term of this patent is extended or adjusted under 35 U.S.C. 154(b) by 0 days.

(21) Appl. No.: 11/554,211

(22) Filed: Oct. 30, 2006

(65) Prior Publication Data

US 2007/0114321 A1 May 24, 2007

(30) Foreign Application Priority Data

Nov. 4, 2005 (FR) ..... 05 53353

(51) Int. Cl.
*B65H 75/18* (2006.01)

(52) U.S. Cl. ..... 242/596.7; 242/596.8; 242/599.4

(58) Field of Classification Search ..... 242/596.5, 242/596.7, 596.8, 588.6, 599.3, 599.4; 312/34.8
See application file for complete search history.

(56) References Cited

U.S. PATENT DOCUMENTS

| | | | | |
|---|---|---|---|---|
| 126,199 | A | | 4/1872 | Gibbs |
| 301,596 | A | | 7/1884 | Hopking |
| 390,084 | A | | 9/1888 | Lane |
| 464,378 | A | | 12/1891 | Morgan |
| 1,479,960 | A | | 1/1924 | Flynn |
| 1,778,282 | A | | 10/1930 | Stewart |
| 2,264,631 | A | | 12/1941 | Fetty |
| 2,371,109 | A | | 3/1945 | Sanford |
| 2,410,328 | A | | 10/1946 | Agamaite, Jr. |
| 2,470,030 | A | | 5/1949 | Habuda |
| 2,514,778 | A | | 7/1950 | Margo |
| 2,533,018 | A | | 12/1950 | Kandarian |
| 2,565,994 | A | | 8/1951 | Sevenich |
| 2,566,883 | A | | 9/1951 | Gove |
| 2,879,012 | A | | 3/1959 | Sarro |
| 3,418,029 | A | | 12/1968 | Wooster |
| 3,428,267 | A | | 2/1969 | Briles |
| 3,516,615 | A | | 6/1970 | Wickenberg |
| 4,487,378 | A | * | 12/1984 | Kobayashi |
| 4,796,825 | A | * | 1/1989 | Hawkins |
| 4,974,783 | A | | 12/1990 | Campbell |
| 5,281,386 | A | * | 1/1994 | Weinert |
| 5,370,336 | A | | 12/1994 | Whittington |
| 5,370,339 | A | | 12/1994 | Moody et al. |

(Continued)

FOREIGN PATENT DOCUMENTS

WO 2005/063103 A1 7/2005

*Primary Examiner*—William A Rivera
(74) *Attorney, Agent, or Firm*—Joel T. Charlton

(57) ABSTRACT

A system for dispensing a strip of absorbent product in a coreless roll, of the type including a roll and a dispenser for dispensing the absorbent product, of the type including a first guiding and positioning element which can be received in a first housing of the roll and including a second holding element which can be received in a second housing of the roll, wherein the first guiding and positioning element includes a portion of revolution with a cross section decreasing towards the inside of the dispenser, which can be received in the first associated housing of the roll.

17 Claims, 2 Drawing Sheets

U.S. PATENT DOCUMENTS

Figure 1:
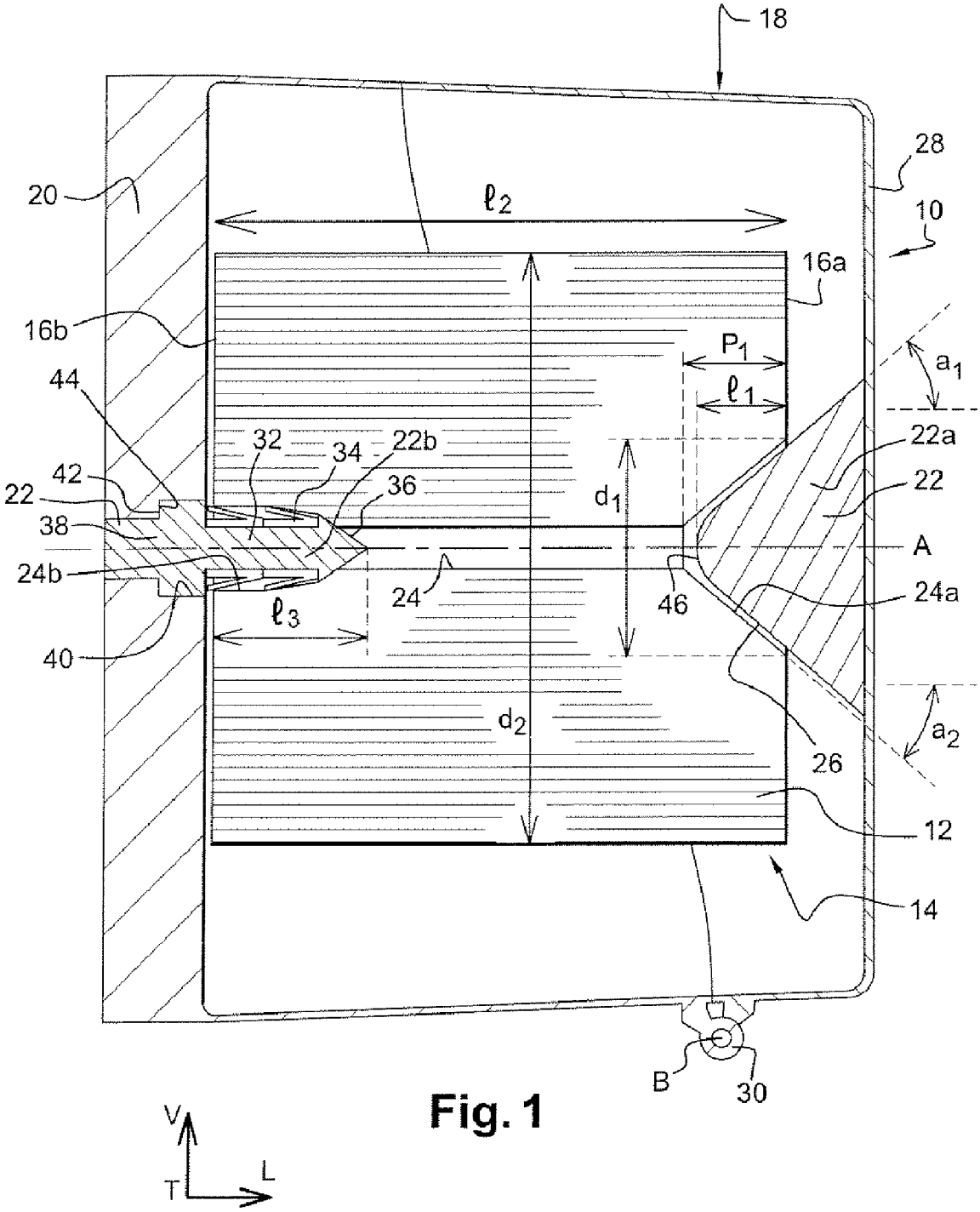

| | | | |
|---|---|---|---|
| 5,620,148 | A * | 4/1997 | Mitchell |
| 5,868,342 | A | 2/1999 | Moody et al. |
| 5,875,985 | A * | 3/1999 | Cohen et al. |
| 6,070,821 | A | 6/2000 | Mitchell |
| 6,082,664 | A | 7/2000 | Phelps et al. |
| 6,360,985 | B1 | 3/2002 | Phelps et al. |
| 6,390,410 | B1 | 5/2002 | LaCount et al. |
| 6,409,120 | B1 * | 6/2002 | Tramontina et al. |
| 6,439,502 | B1 * | 8/2002 | Gemmell et al. |
| 6,502,781 | B1 | 1/2003 | Tramontina |
| 7,066,423 | B2 * | 6/2006 | Andersson |
| 7,316,369 | B2 | 1/2008 | Phelps |
| 2004/0129825 | A1 | 7/2004 | Andersson |
| 2005/0139721 | A1 * | 6/2005 | Andersson |
| 2006/0000941 | A1 | 1/2006 | Lewis et al. |
| 2007/0267532 | A1 | 11/2007 | Phelps |

* cited by examiner

SYSTEM FOR DISPENSING PAPER IN A CORELESS ROLL, METHOD OF MANUFACTURING A ROLL OF THIS TYPE, AND ROLL OF PAPER

This application claims priority to copending French patent application number 05 53353 filed Nov. 4, 2005, the disclosure of which is incorporated herein by reference.

The invention relates to a system for dispensing paper in coreless roll and the method of manufacturing a roll of this type.

The invention relates more particularly to a system for dispensing a strip of absorbent product in a coreless roll, of the type including:

- a roll, formed from a wound strip of absorbent product, of substantially cylindrical shape and delimited axially by a first lateral side and a second axially opposed lateral side;
- a dispenser for dispensing the absorbent product by rotation of the roll about an axis, of the type including a frame and means for holding and guiding the roll in rotation with respect to the frame, the means for holding and guiding the roll in rotation including a first guiding and positioning element which can be received axially in a first complementary housing positioned at the center of the first associated side of the roll and including a second holding element which can be received axially in a second complementary housing positioned in the center of the second associated side of the roll.

Numerous examples of dispensing systems of this type are known.

Most of these are systems for dispensing paper for one-time use, particularly for the general public and for groups of persons, the paper being known as toilet paper, cleaning roll, kitchen roll or paper towel roll.

To ensure the quality of the dispensed product, some manufacturers have developed what are called "captive" systems, which can accept only one type of product or a specified group of products.

There are different systems for making the system "captive".

In particular, the prior art includes specially shaped plastic end caps, which are placed for example inside a core on which the product is wound, and which interact with supports placed in the dispenser. Without these end caps, the roll cannot be put in place, or cannot be used correctly.

The principal drawback of this type of device is an economic one: it is necessary to manufacture additional elements which are not of great importance to the user of the system and which are unusable when the roll has been finished. These plastic pieces therefore represent an additional cost and increased waste when the roll is finished.

There are also known rolls including sides provided with a groove, each interacting with a special support: a roll without a groove cannot be held in the dispenser, or alternatively the door of the dispenser cannot be closed, because of the difference in overall dimensions between the roll without a groove and a roll with grooves.

This type of system is efficient, but the manufacture of these apertures requires complex installations for converting the rolls.

To overcome these drawbacks, the invention proposes an economic means for making the pair consisting of the dispenser and paper roll captive, without adding further elements to the roll.

For this purpose, the invention proposes a system for dispensing a strip of absorbent product of the type described above, characterized in that at least the first guiding and positioning element includes a portion of revolution having a cross section decreasing towards the inside of the dispenser, this portion being capable of being received axially in the first associated housing of the roll.

According to other characteristics of the invention:

- the dispenser includes a cover which is mounted to be movable with respect to the frame, between an open position for the positioning of a roll and a closed position for the use of the roll, and in that the cover carries the first guiding and positioning element carrying the portion of revolution of decreasing cross section;
- the cover is mounted pivotably with respect to the frame about an axis transverse and orthogonal to the axis of rotation of the roll;
- the first housing associated with the portion of revolution of decreasing cross section of the first guiding and positioning element extends axially into the roll from the first side, over an axial length which is less than or equal to half the axial length of the roll;
- the first housing associated with the portion of revolution of decreasing cross section extends axially into the roll over an axial length which is less than or equal to one third of the axial length of the roll;
- the maximum diameter of the first housing associated with the portion of revolution with a decreasing cross section is less than or equal to half the diameter of the new roll;
- the maximum diameter of the first housing associated with the portion of revolution with a decreasing cross section is less than or equal to one third of the diameter of the new roll;
- the portion of the first guiding and positioning element is a conical or truncated conical portion;
- the portion of the first guiding and positioning element has a tip of rounded shape.

The invention also relates to a method of manufacturing a roll for the dispensing system according to the invention, characterized in that it includes a step in which one side of the roll is axially deformed by means of a tool preferably of truncated conical shape, so as to form the housing which can interact with a guiding and positioning element including a portion of revolution with a decreasing cross section.

The invention also relates to a roll formed from a wound strip of absorbent product for a dispensing system according to the invention, characterized in that the first complementary housing positioned in the center of the first associated side of the roll has a shape of revolution with a cross section decreasing towards the inside of the roll.

Figure 2A:
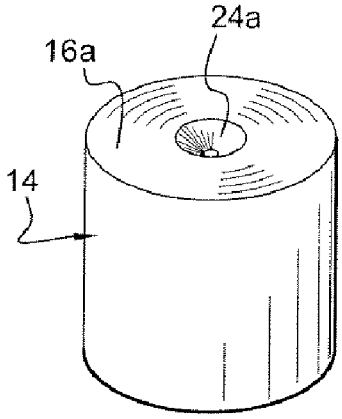
Figure 2B:
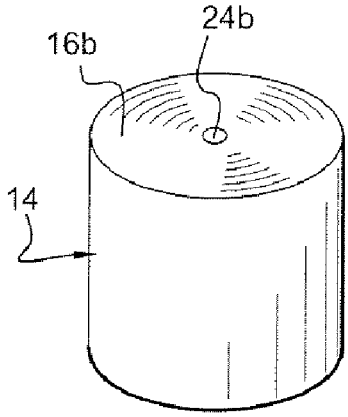
Figure 3:
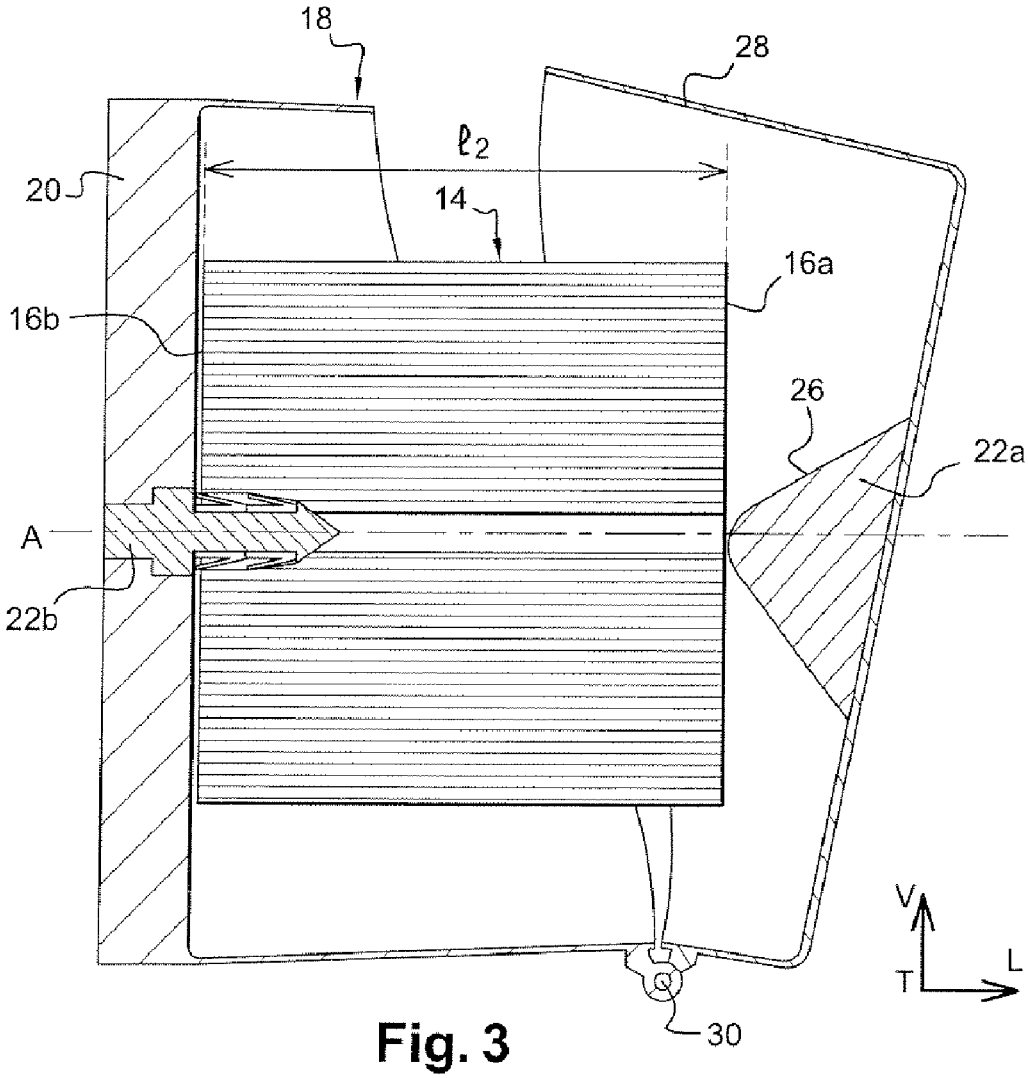

Other characteristics and advantages of the invention will be made clear by the following detailed description, the comprehension of which will be facilitated by reference to the attached drawings, in which:

FIG. 1 is a front view in longitudinal section of the dispensing system according to the invention;

FIG. 2*a* is a perspective view of a roll of paper according to the invention, showing a first side including a housing according to one embodiment of the invention;

FIG. 2*b* is a view identical to that of FIG. 2*a*, showing a second side of the roll according to the invention;

FIG. 3 is a view in longitudinal section of a dispensing system which includes a roll according to the prior art.

In the following description, provided without restrictive intent, identical, analogous or similar components are identified by the same reference numerals.

In the description and the claims, the vertical, longitudinal and transverse directions according to the frame of reference L, V, T shown on the figures are used, without restrictive intent.

FIG. 1 shows a system 10 for dispensing an absorbent product wound around a housing 24 in a coreless roll 14 according to the invention.

In this case, the absorbent product is a roll 14 of a strip of paper 12, shown in FIGS. 2*a* and 2*b*, such as toilet paper, having a cylindrical shape delimited axially by asymmetric first side 16*a* and second lateral side 16*b* opposite each other, such that the roll 14 is asymmetrical.

The housing 24 passes through the roll 14 from one side to the other, and includes a first housing 24*a* and a second housing 24*b* opening on the sides 16*a* and 16*b* of the roll 14 respectively.

The dispensing system 10 also includes a dispenser 18 for dispensing the paper 12 of the roll 14. The paper 12 is dispensed by rotating the roll 14 about a substantially longitudinal axis A.

For this purpose, the dispenser includes a frame 20 which is advantageously fixed securely to a wall (not shown).

The dispenser 18 includes a cover 28 mounted movably with respect to the frame 20 with the aid of rotation means 30 which consist of a pivoting link having the axis B such as a hinge, for example. The cover 28 can thus be opened and closed by a rotary movement about the axis B which is transverse and orthogonal to the axis A of rotation of the roll 14.

The cover 28 can therefore assume an open position for the positioning of the roll 14 and a closed position for the dispensing of the paper 12, shown in FIG. 1.

The frame 20 and the cover 28 can be, but are not necessarily, made in one piece, in which case the frame 20 and the cover 28 would be joined together by a thin portion which enables the cover 28 to be opened with respect to the frame 20, by example.

In a known way, the dispenser 18 includes means 22 for holding and guiding the roll 14 in rotation.

As shown more precisely in FIG. 1, the means 22 for holding and guiding the roll 14 in rotation include a first guiding and positioning element 22*a* which can be received axially in the first housing 24*a* of complementary shape positioned in the center of the first associated side 16*a* of the roll 14. The means 22 include a second holding element 22*b* which can be received axially in the second complementary housing 24*b* positioned in the center of the second side 16*b* associated with the roll 14.

According to the invention, the first guiding and positioning element 22*a* includes a portion of revolution 26 with a cross section decreasing towards the inside of the dispenser 18, which can be received axially in the first associated housing 24*a* of the roll 14.

In a preferred embodiment, the portion of revolution 26 with a cross section decreasing towards the inside of the dispenser 18 is of substantially conical shape and extends axially from the first side 16*a* into the first housing 24*a* of the roll 14, when the cover 28 is in a closed position, over a length 11 which is less than or equal to one third of the axial length 12, or width, of the roll 14.

Additionally, the conical portion of revolution 26 is positioned with respect to the cover 28 in such a way that, when the latter is in the closed position, the conical portion of revolution 26 is positioned in the first housing 24*a* coaxially with the roll 14.

The portion of revolution 26 also has an end tip 46 of rounded shape without any sharp angle. Advantageously, the rounded shape of the tip 46 avoids damage to the strip of absorbent product 12 of the roll 14 in contact with the portion of revolution 26.

The first housing 24*a* which is positioned in the center of the first side 16*a* has a shape which can interact with the conical portion of revolution 26. Thus the first housing 24*a* is of conical shape in this case and has an angle a2 of revolution with respect to the axis A substantially identical to the angle a1 of revolution of the conical portion of revolution 26 with respect to the axis A.

For information only, the optimal angle a1 can be in the range from 30° to 55°. Advantageously, the first housing 24*a* has a maximum diameter d1 less than or equal to one third of the diameter d2 of the new roll 14.

The second holding element 22*b* is of the "harpoon" type, known in the prior art, and has a generally cylindrical shape.

At a first end, the second holding element 22*b* includes a fastening portion 32 which is positioned in the second housing 24*b*, shown in FIG. 2*b*, of the second side 16*b* of the roll 14, coaxially with the roll 14.

The fastening portion 32 includes radially projecting elements 34, such as fins 34, which extend in a substantially diagonal direction with respect to the longitudinal axis A of the roll 14 in such a way that the fins 34 oppose the withdrawal of the second holding element 22*b* when the latter is pushed into the roll 14, as shown in FIG. 1 for example.

The fins 34 are preferably free to rotate about the axis A with respect to the fastening portion 32 and the portion 32 is fixed with respect to the frame 20.

The fastening portion 32 also has a chamfer 36 to facilitate the insertion of the second holding element 22*b* into the roll 14.

The fastening portion 32 of the second holding element 22*b* preferably has an axial length 13 equal to or less than one third of the axial length 12 of the roll 14.

At a second end, the second holding element 22*b* includes a portion 38 fixed in a bore 40 of the frame 20 along the longitudinal axis A of the roll 14.

The second holding element 22*b* also includes a shoulder 42 which interacts with an annular seat 44 of the bore 40 of the frame 20 so as to prevent the axial displacement along the axis A of the second holding element 22*b* towards the outside of the dispenser 18.

This design facilitates the positioning and placement of the roll 14 in the dispenser 18.

Advantageously, the conical shape of the portion of revolution 26 makes the roll 14 self-centering with respect to the cover 28, thus ensuring that the system is a captive one.

The invention also relates to a method of manufacturing the roll 14.

The method of manufacturing the roll 14 includes a step in which one side of the roll 14, in this case the first side 16*a*, is deformed to form the first housing 24*a* by means of a male tool (not shown), of truncated conical shape for example, moved by a machine of the press type, which crushes the plies of the paper 12 in the center of the first side 16*a* of the roll 14 in such a way that the first housing 24*a* can interact with the conical portion of revolution 26 of the first holding element 22*a*.

For information only, the first housing 24*a* formed in this way can have a maximum depth p1 equal to one third of the axial length 12 of the roll 14, and preferably equal to one fifth of this length 12, in order not to deform the roll 14 excessively. For the same reason, the maximum diameter d1 of the first housing 24*a* is less than half the diameter d2 of the roll 14, and preferably less than or equal to one third of the diameter d2 of the roll 14.

The conicity of the first housing 24*a* formed in this way does not affect the characteristics of the use of the paper sheets 12 forming the roll 14.

In a variant embodiment, the second holding element 22*b* includes a conical shape substantially identical to that of the first guiding and positioning element 22*a*, possibly having different dimensions.

In this variant embodiment, the roll 14 has a housing 24*a* and 24*b* of conical shape in each of its sides 16*a* and 16*b* respectively.

Thus the first guiding and positioning element 22*a*, of conical shape for example, prevents a roll which does not have a housing 24*a* of suitable shape from being usable in the system 10.

As shown in FIG. 3, a standard roll 14 having an axial length 12 identical to that of the roll 14 according to the invention, which for information may be approximately 95 mm, without any deformation or housing 24*a*, can be held in place in the dispenser 18.

However, it would be difficult to dispense it correctly, since the cover 28 of the dispenser 18 could not be closed, owing to the protuberance formed by the conical portion of revolution 26 which impedes its closing. Even if the cover 28 were somehow closed, the correct unwinding of the roll 14 would be adversely affected by the presence of an excessively strong frictional force between the roll 14 and the conical portion of revolution 26.

Furthermore, the conical shape of the first guiding and positioning element 22*a* facilitates the guiding and positioning of the roll 14 with respect to the cover 28 when the latter moves from an open to a closed position.

Moreover, the conical shape of the first guiding element 22*a* helps to position a roll 14 of appropriate shape if the second holding element 22*b* has been positioned incorrectly or not at all.

Without departing from the scope of the invention, the means 22 for holding and guiding the roll 14 in rotation can form part of a structural element not permanently connected to the frame 20 of the dispenser 18.

What is claimed is:

1. A system for dispensing a strip of absorbent product in a coreless roll, comprising:

a roll, formed from a wound strip of absorbent product, of substantially cylindrical shape and delimited axially by a first lateral side and a second axially opposed lateral side, the roll having an axially disposed housing that passes therethrough from the first lateral side to the second lateral side, a section of the housing at the first lateral side having a preformed hollow shape that extends with a reducing diameter into the body of the roll to define a first complementary housing;

a dispenser for dispensing the absorbent product by rotation of the roll about an axis(A), the dispenser comprising a frame and means for holding and guiding the roll in rotation with respect to the frame, wherein the means for holding and guiding the roll in rotation comprises a first guiding and positioning element adapted to be received axially in the first complementary housing positioned at a center of the first associated side of the roll, and comprises a second holding element adapted to be received axially in a second complementary housing positioned in the center of the second associated side of the roll, and wherein at least the first guiding and positioning element comprises a portion of revolution with a cross section decreasing towards an inside of the dispenser, the portion of revolution having a shape complementary to the preformed hollow shape of the section of the housing at the first lateral side of the roll, and is adapted to be received axially in the first complementary housing of the roll.

2. The system according to claim 1, further comprising a cover, which is mounted to be movable with respect to the frame between an open position for the positioning of a roll and a closed position for the use of the roll, wherein the cover carries the first guiding and positioning element carrying the portion of revolution with a decreasing cross section.

3. The system according to claim 2, wherein the cover is mounted pivotably with respect to the frame about an axis (B) transverse and orthogonal to the axis (A) of rotation of the roll.

4. The system of claim 2, wherein the portion of revolution is permanently connected to the cover.

5. The system of claim 2, wherein:

in the presence of the roll having the preformed hollow shape facing toward the cover, closure of the cover with respect to the frame is permitted by virtue of the portion of revolution being received within the preformed hollow shape upon closure; and in the presence of the roll not having the preformed hollow shape facing toward the cover, closure of the cover with respect to the frame is not permitted by virtue of the portion of revolution interfering with the respective lateral side of the roll.

6. The system according to claim 1, wherein the first housing extends axially into the roll from the first side, over an axial length less than or equal to half the axial length of the roll.

7. The system according to claim 6, wherein the first housing extends axially into the roll over an axial length less than or equal to one third of the axial length of the roll.

8. The system according to claim 1, wherein a maximum diameter (d1) of the first housing is less than or equal to half the diameter (d2) of the roll.

9. The system according to claim 8, wherein the maximum diameter (d1) is less than or equal to one third of the diameter (d2) of the roll.

10. The system according to claim 1, wherein the portion of the first guiding and positioning element is a conical or truncated conical portion.

11. The system according to claim 10, wherein the portion of the first guiding and positioning element has a tip of rounded shape.

12. The system of claim 1, wherein the roll comprises asymmetric first and second lateral sides as defined by the first complementary housing having the preformed hollow shape and the second complementary housing being an extension of the axially disposed housing that passes through the roll.

13. A method of manufacturing an asymmetrical coreless roll, comprising:

axially deforming an axial region at only one side of the roll using a tool so as to form a conical depression in only one side of the roll.

14. The method according to claim 13, wherein the tool has a truncated conical shape, so as the depression has a corresponding shape.

15. The method according to claim 13, wherein the depression has a decreasing cross section in a direction toward an inside of the roll.

16. A coreless roll, comprising:

a roll, formed from a wound strip of absorbent product, of substantially cylindrical shape and delimited axially by a first lateral side and a second axially opposed lateral side, the roll having an axially disposed housing that passes therethrough from the first lateral side to the second lateral side, a section of the housing at the first lateral side having a preformed hollow shape that extends with a reducing diameter into the body of the roll to define a conical depression.

17. The coreless roll according to claim 16, wherein the depression has a truncated conical shape.

* * * * *